US007637697B1

(12) United States Patent
Holland

(10) Patent No.: US 7,637,697 B1
(45) Date of Patent: Dec. 29, 2009

(54) TRENCHER BOOT AND METHODS OF LAYING UNDERGROUND CABLE

(76) Inventor: Charles S. Holland, 1400 S. Fourth St., Forest City, IA (US) 50436

( * ) Notice: Subject to any disclaimer, the term of this patent is extended or adjusted under 35 U.S.C. 154(b) by 0 days.

(21) Appl. No.: 12/248,696

(22) Filed: Oct. 9, 2008

(51) Int. Cl.
*E02F 5/10* (2006.01)

(52) U.S. Cl. ..... 405/180; 405/174; 405/177; 405/178

(58) Field of Classification Search ..... 405/174, 405/177, 178, 180
See application file for complete search history.

(56) References Cited

U.S. PATENT DOCUMENTS

| | | | | |
|---|---|---|---|---|
| 3,201,948 | A * | 8/1965 | Schramm | 405/174 |
| 3,394,554 | A * | 7/1968 | Kinnan | 405/183 |
| 3,395,545 | A * | 8/1968 | Mendaloff, Jr. | 405/178 |
| 3,802,210 | A | 4/1974 | D'Andrea | |
| 3,849,999 | A | 11/1974 | Coffey | |
| 3,851,489 | A | 12/1974 | Richardson | |
| 3,948,059 | A | 4/1976 | Pompa | |
| 4,318,638 | A | 3/1982 | Promersberger et al. | |
| 4,332,511 | A | 6/1982 | Bradley et al. | |
| 4,650,370 | A * | 3/1987 | Kassner et al. | 405/183 |
| 4,714,381 | A | 12/1987 | Hatch | |
| 4,741,646 | A | 5/1988 | Hatch | |
| 6,478,508 | B1 | 11/2002 | Magnani et al. | |
| 7,090,433 | B2 * | 8/2006 | Searby | 405/183 |
| 2005/0089374 | A1 | 4/2005 | Belluschi | |

* cited by examiner

*Primary Examiner*—David J Bagnell
*Assistant Examiner*—Nicholas A Wilbur
(74) *Attorney, Agent, or Firm*—Parsons & Goltry; Michael W. Goltry; Robert A. Parsons

(57) ABSTRACT

A trencher boot includes a boxlike structure formed with a compartment extending from an inlet formed in an upper end of the trencher boot to an outlet formed in a lower end of the trencher boot. A cable-orienting structure is formed within the compartment between the inlet and the outlet. The compartment is to concurrently receive three cables from the inlet, guide the three cable to the cable-orienting structure, which interacts with the three cables to arrange the three cables in a V-shaped orientation comprising two of the three cables positioned side-by-side atop a third one of the three cables, and guide the three cables in the V-shaped orientation from the cable-orienting structure to the lower end of the trencher boot and outwardly through the outlet into the V-shaped receiving area formed in the bottom of the trench, which maintains the three cables in the V-shaped orientation.

18 Claims, 8 Drawing Sheets

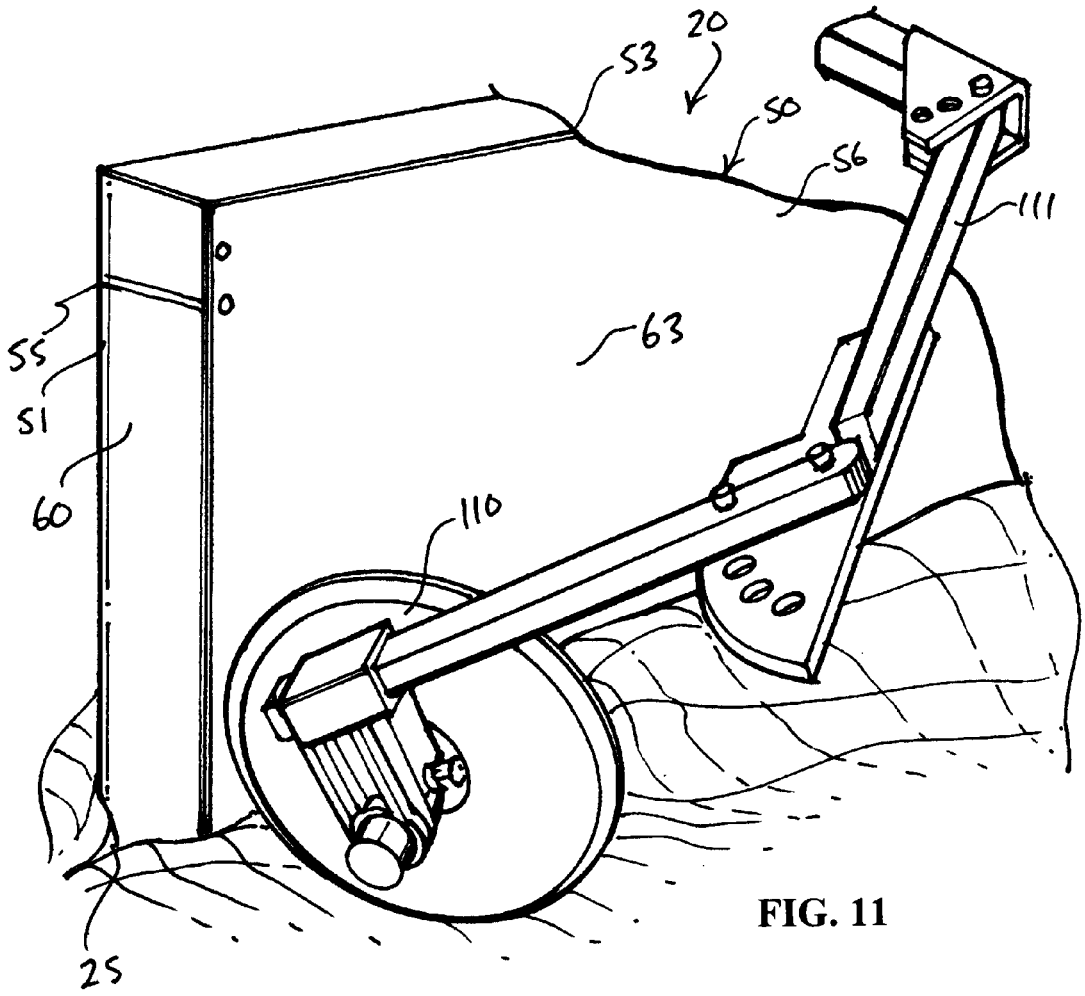
FIG. 11
FIG. 12
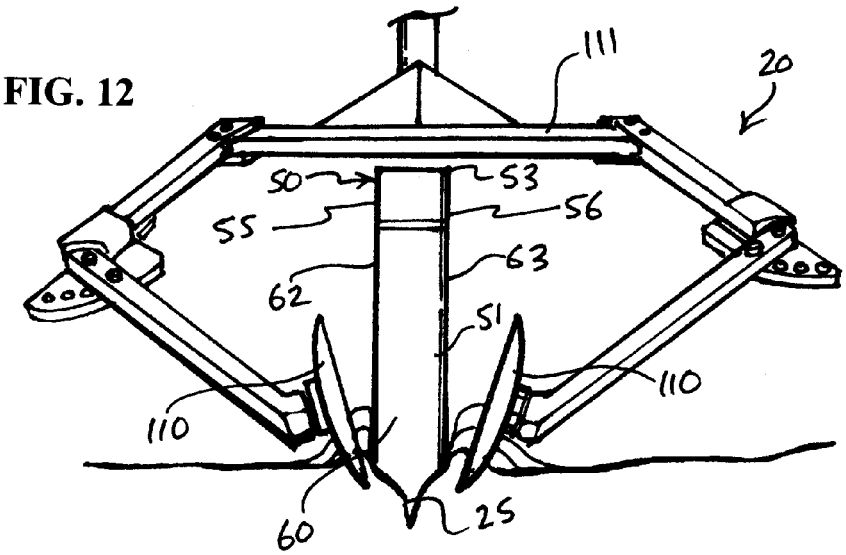

TRENCHER BOOT AND METHODS OF LAYING UNDERGROUND CABLE

FIELD OF THE INVENTION

The present invention relates to trenchers used in the excavation of trenches and, more particularly, to trencher boots used to feed cable into a trench formed by a trencher.

BACKGROUND OF THE INVENTION

Medium- and high-voltage electric cables are often installed underground. Medium- and high-voltage electric cables are expensive and generate large amounts of heat when passed through by electrical current. Burying these cables underground in a mass of soil and rock or other like or similar mass of inert material not only protects the cables from damage and theft, but also dissipates heat generated by the cables.

A typical underground cable installation involves forming a trench, laying cables onto the bottom of the trench, and then backfilling the trench with fill material, such as soil, sand, rock, concrete, or other selected fill material or combination of materials. In some applications, a preliminary base layer of inert material is laid down onto the bottom of the trench onto which cables are placed, which is followed by the application of a covering layer of inert material that together with the previously deposited base layer form the mass of inert material completely incorporating the cables.

Installing medium- and high-voltage electrical cables underground is intensely labor intensive. As a result, skilled artisans have devoted considerable time, effort, and resources toward developing not only specialized, mechanized trenchers used in forming trenches, but also implements used to apply electric cables to formed trenches. Although significant advancements have been made in the field of laying underground cable, particularly in the advancement of improved trenchers and associated cable-laying implements, comparatively little attention has been directed to improving the architecture of multi-cable, underground installations, and to specialized implements adapted to concurrently lay multiple cables in arrangements designed to allow the installed cables to better withstand the load applied to the cables from the fill material within which the cables are buried, and to dissipate heat more efficiently, all of which contribute to prolonged cable life coupled with improved cable performance.

SUMMARY OF THE INVENTION

The above problems and others are at least partially solved and the above objects and others realized in an apparatus for laying three cables onto a bottom of a trench, including a trencher boot having opposed leading and trailing ends, opposed upper and lower ends, opposed sides, and a blade structure formed in the lower end of the boxlike structure to engage the bottom of the trench to form a substantially V-shaped receiving area in the bottom of the trench as the trencher boot is advanced through the trench. A compartment is formed within the trencher boot, which extends from an inlet formed in the upper end of the trencher boot adjacent to the leading end of the trencher boot to an outlet formed in the lower end of the trencher boot adjacent to the trailing end of the trencher boot. A cable-orienting structure is formed within the compartment between the inlet and the outlet. The compartment is to concurrently receive three cables from the inlet, guide the three cable to the cable-orienting structure, which interacts with the three cables to arrange the three cables in a V-shaped orientation comprising two of the three cables positioned side-by-side atop a third one of the three cables, and guide the three cables in the V-shaped orientation from the cable-orienting structure to the lower end of the trencher boot and outwardly through the outlet into the V-shaped receiving area formed in the bottom of the trench. According to the principle of the invention, the V-shaped receiving area is sized and shaped to receive the three cables in the V-shaped orientation from the outlet of the trencher boot and maintain the three cables in the V-shaped orientation. In a particular embodiment, the cable-orienting structure includes a bump out formed on either side of the compartment adjacent to the outlet to define a restricted region of the compartment therebetween, in which the bump outs interact with the three cables passing through the restricted region to arrange the three cables in the V-shaped orientation. A guide roller is formed between the outlet of the compartment and the bump outs, which receives the cables in the V-shaped orientation from the bump outs and applies the cables in the V-shaped orientation outwardly from the trencher boot through the outlet. The inlet into the compartment is buffered to prevent damage to the three cables entering the compartment through the inlet. In a particular embodiment, the inlet into the compartment is buffered with at least one roller formed in the upper end of the trencher boot at the inlet. At least one plow is formed with the trencher boot to direct fill into the trench onto the three cables applied to the V-shaped receiving area as the trencher boot is advanced through the trench in a direction leading with the leading end of the trencher boot.

According to the principle of the invention, an apparatus for laying three cables onto a bottom of a trench includes a trencher boot having opposed leading and trailing ends, opposed upper and lower ends, opposed sides, and a blade structure formed in the lower end of the boxlike structure to engage the bottom of the trench to form a substantially V-shaped receiving area in the bottom of the trench as the trencher boot is advanced through the trench. A compartment is formed within the trencher boot, and extends from an inlet formed in the upper end of the trencher boot adjacent to the leading end of the trencher boot to an outlet formed in the lower end of the trencher boot adjacent to the trailing end of the trencher boot. Orienting rollers are formed in the compartment, which define a restricted region of the compartment therebetween. The compartment is to concurrently receive three cables from the inlet, guide the three cables to the restricted region formed between the orienting rollers, which interact with the three cables to arrange the three cables in a V-shaped orientation comprising two of the three cables positioned side-by-side atop a third one of the three cables, and guide the three cables in the V-shaped orientation from the orienting rollers to the lower end of the trencher boot and outwardly through the outlet into the V-shaped receiving area formed in the bottom of the trench. The V-shaped receiving area is sized and shaped to receive the three cables in the V-shaped orientation from the outlet of the trencher boot and maintain the three cables in the V-shaped orientation. A guide roller is formed between the outlet of the compartment and the orienting rollers, which receives the cables in the V-shaped orientation from the orienting rollers and applies the cables in the V-shaped orientation outwardly from the trencher boot through the outlet. The inlet into the compartment is buffered to prevent damage to the three cables entering the compartment through the inlet. In a particular embodiment, the inlet into the compartment is buffered with at least one roller formed in the upper end of the trencher boot at the inlet. At least one plow is formed with the trencher boot to direct fill into the trench onto the three cables applied to the V-shaped receiving area as the trencher boot is advanced through the trench in a direction leading with the leading end of the trencher boot.

According to the principle of the invention, a method for laying three cables onto a bottom of a trench includes providing a trencher boot having opposed leading and trailing ends, opposed upper and lower ends, opposed sides, a blade structure formed in the lower end of the boxlike structure, a compartment formed within the trencher boot extending from an inlet formed in the upper end of the trencher boot adjacent to the leading end of the trencher boot to an outlet formed in the lower end of the trencher boot adjacent to the trailing end of the trencher boot, and a cable-orienting structure formed within the compartment between the inlet and the outlet. The method further includes positioning the trencher boot in the trench applying the blade structure against the bottom of the trench, advancing the trencher boot through the trench in a direction from the leading end of the trencher boot the trailing end of the trencher boot, the blade structure interacting with the bottom of the trench forming a V-shaped receiving area trailing the trailing end of the trencher boot, applying three cables into and through the compartment from the inlet to the outlet, the cable-orienting structure interacting with the three cables between the inlet and the outlet arranging the three cables in a V-shaped orientation comprising two of the three cables positioned side-by-side atop a third one of the three cables, and applying the three cables in the V-shaped orientation to the V-shaped receiving area from the outlet of the compartment, and the V-shaped receiving area receiving the three cables in the V-shaped orientation from the outlet of the trencher boot, and maintaining the three cables in the V-shaped orientation. The cable-orienting structure includes a bump out formed on either side of the compartment adjacent to the outlet to define a restricted region of the compartment therebetween, and the three cables are passing through the restricted region and the bump outs are interacting with the three cables passing through the restricted region to arrange the three cables in the V-shaped orientation. Further to the present embodiment is a step of applying a guide roller within the trencher boot adjacent to the outlet, and the guide roller receiving the cables in the V-shaped orientation from the bump outs and applying the cables in the V-shaped orientation outwardly from the trencher boot through the outlet to the V-shaped region formed in the bottom of the trench. An additional step includes buffering the inlet into the compartment to prevent damage to the three cables entering the compartment through the inlet. In a particular embodiment, the step of buffering the inlet into the compartment includes applying at least one roller in the upper end of the trencher boot at the inlet. Still further to the present embodiment is the step of applying fill to the trench to cover the cables applied to the V-shaped region formed in the bottom of the trench. To apply fill to the trench involves forming at least one plow with the trencher boot directing fill into the trench onto the three cables applied to the V-shaped receiving area as the trencher boot is advanced through the trench.

BRIEF DESCRIPTION OF THE DRAWINGS

Referring to the drawings:

FIG. 11 is an enlarged, fragmented, rear perspective view of a plow of the trencher boot of FIG. 1 shown as it would appear applying fill to the trench as the trencher boot is advanced through the trench; and FIG. 12 is a rear elevational view of the trencher boot of FIG. 1 illustrating plows of the trencher boot shown as they would appear applying fill to the trench as the trencher boot is advanced through the trench.

DETAILED DESCRIPTION OF A PREFERRED EMBODIMENT

Figure 1:
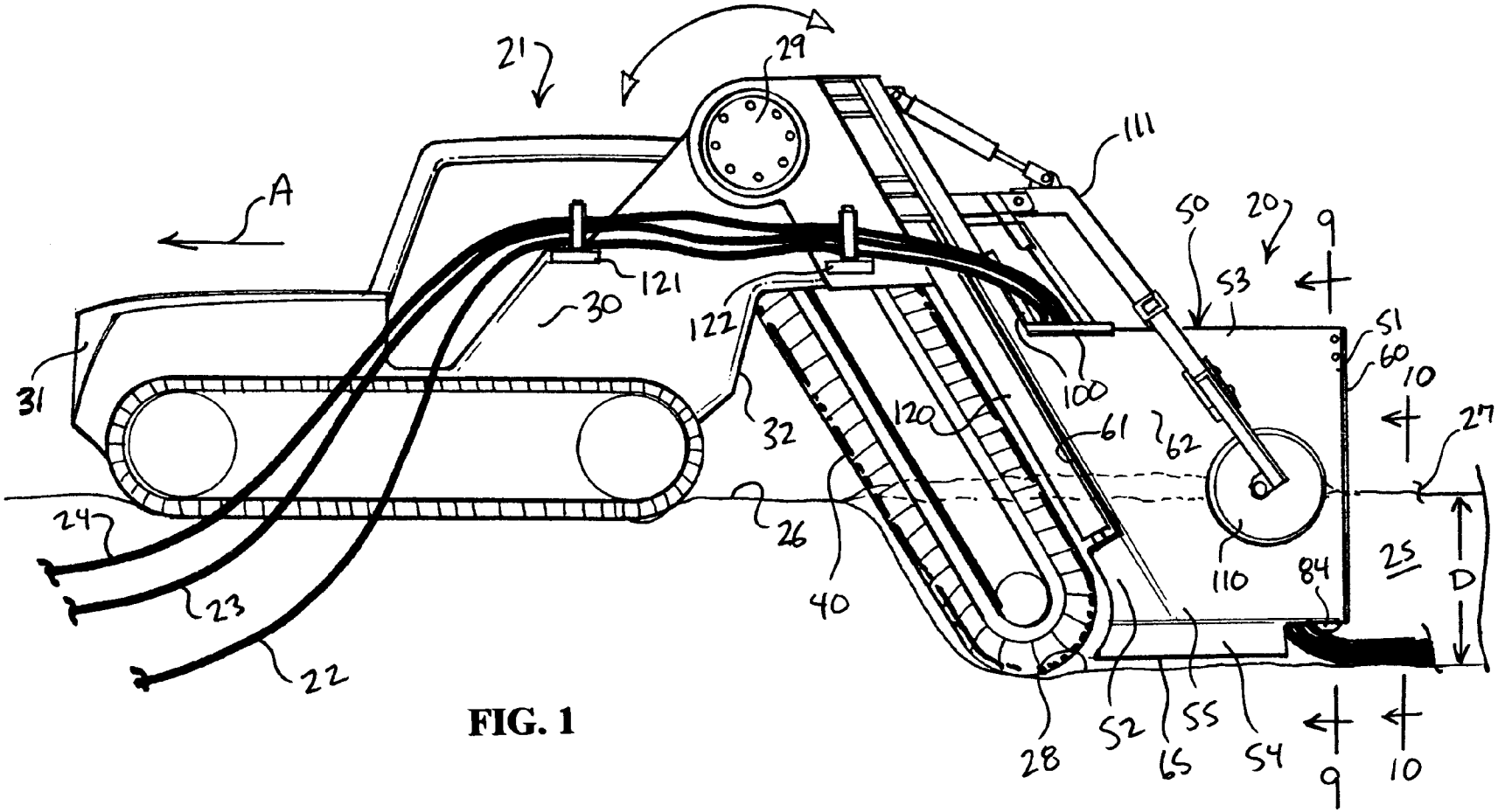
FIG. 1 is a highly generalized side elevational view of a trencher boot shown as it would appear towed behind a trencher laying three cables into a trench formed by the trencher, the trencher boot constructed and arranged in accordance with the principle of the invention.

Turning now to the drawings, in which like reference characters indicate corresponding elements throughout the several views, attention is first directed to FIG. 1 in which there is seen a highly generalized side elevational view of a trencher boot 20 shown as it would appear in use towed behind a trencher 21 receiving and laying three cables 22, 23, and 24, into a trench 25 formed by trencher 21. Cables 22, 23, and 24 are conventional medium or high voltage power cables designed and constructed to be installed underground. Trencher 21 consists of a self-propelled tractor type vehicle 30 traveling on ground surface 26, which supports an attached trench cutter 40 that can be raised and lowered. Vehicle 30 is large and powerful, and has opposed front and rear ends 30 and 31. Reference character A represents the direction in which the tractor is moving during operation. Trench cutter 40 is attached to rear end 31 of vehicle 30, and in this example is generally representative of a conventional chain-type trench cutter well known by those having regard for the art. Trench cutter 40 is towed behind rear end 31 of vehicle 30, and is movable about a mechanical pivot 29 between raised and lowered positions. In operation, trench cutter 40 is moved into its lowered position and cuts into the ground through ground surface 26 to form trench 25 as shown in FIG. 1 as vehicle 30 is driven and advanced along ground surface 26 in the direction denoted by the arrowed line A.

Trench 25 is a long, narrow excavation in the ground, and has an open upper end 27 formed in ground surface 26, and extends downwardly therefrom into the ground to a bottom 28. Trench 25 has a substantially uniform depth D extending from open upper end 27 to bottom 28. Depth D of trench 25 is from three to six feet in the present embodiment, although depth D may fall outside this exampled range if needed.

Trencher 21 does not form a part of the invention and is generally representative of a well-known trencher, further details of which will readily occur to those having ordinary skill in the art and are not discussed in further detail. Trench cutter 40 is a conventional chain-type cutter in the example set forth in FIG. 1. In other embodiments, trench cutter can be a wheel cutter, a rockwheel cutter, or other selected cutter form useful in cutting trenches into the ground. Trench cutter 40 is attached to vehicle 30 and is towed behind vehicle 30 and may be considered a part of, or otherwise an extension of, vehicle 30. Trencher boot 20 is, in turn, attached to trench cutter 40 and in use is towed behind trench cutter 40. If desired, trencher boot 20 can be attached directly to vehicle 30, rather than directly to trench cutter 40. When attached directly to either vehicle 30 or trench cutter 40, trencher boot 20 may be considered part of or otherwise and extension of vehicle 30, or part of or otherwise an extension of trench cutter 40, as may be desired.

Figure 2:
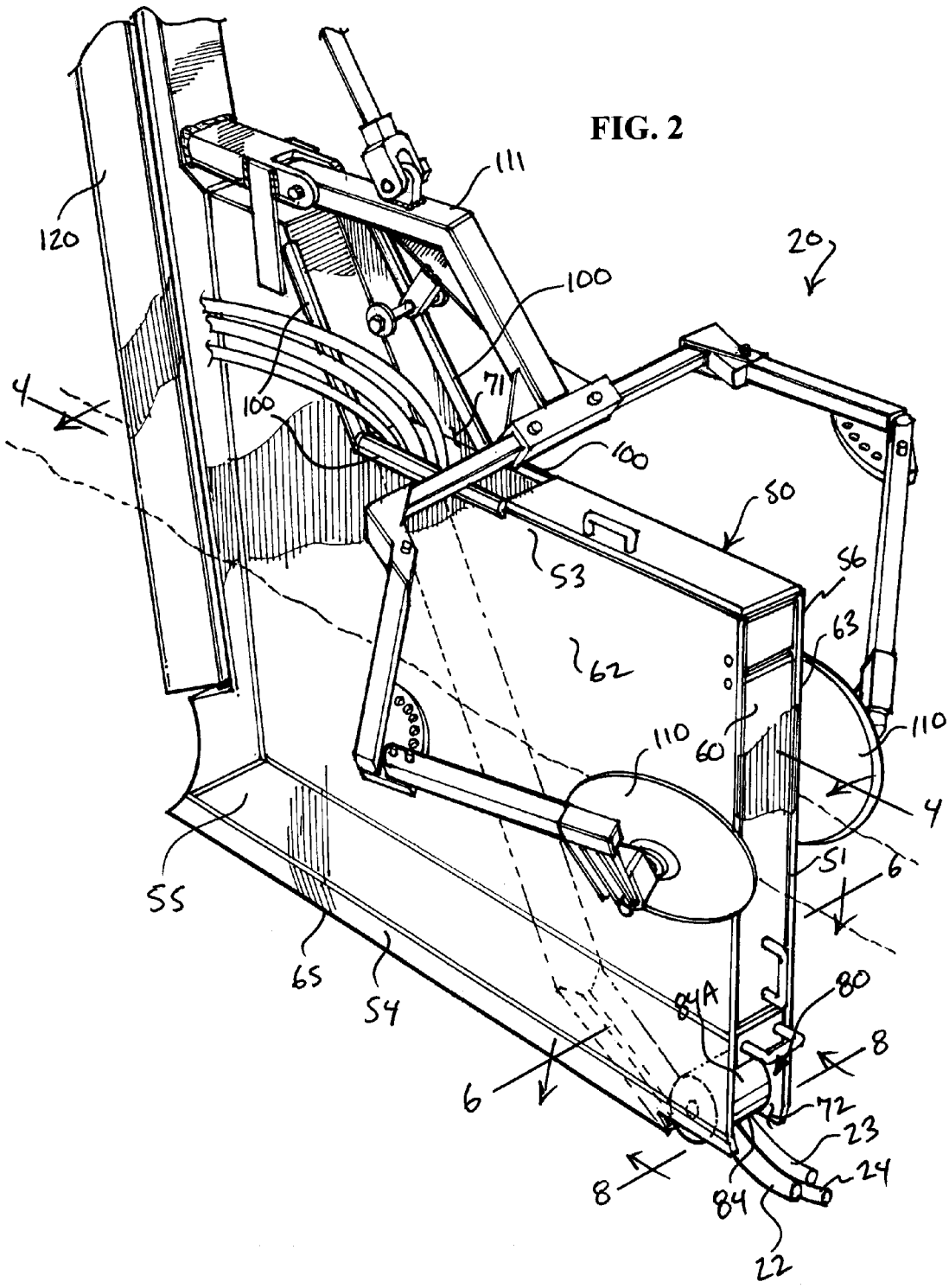
FIG. 2 is a perspective view of the trencher boot of FIG. 1.
Figure 3:
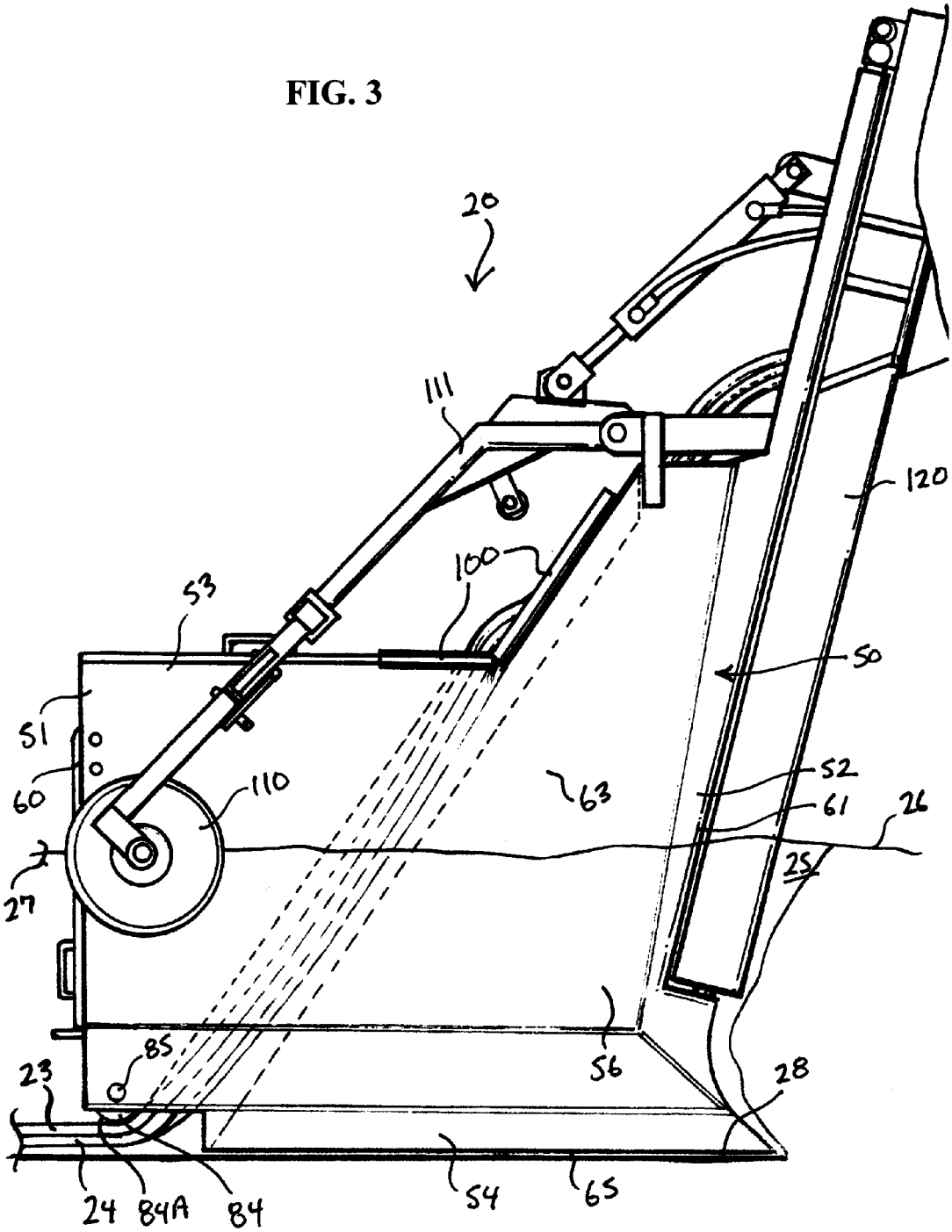
FIG. 3 is a side elevational view of the trencher boot of FIG. 1.
Figure 4:
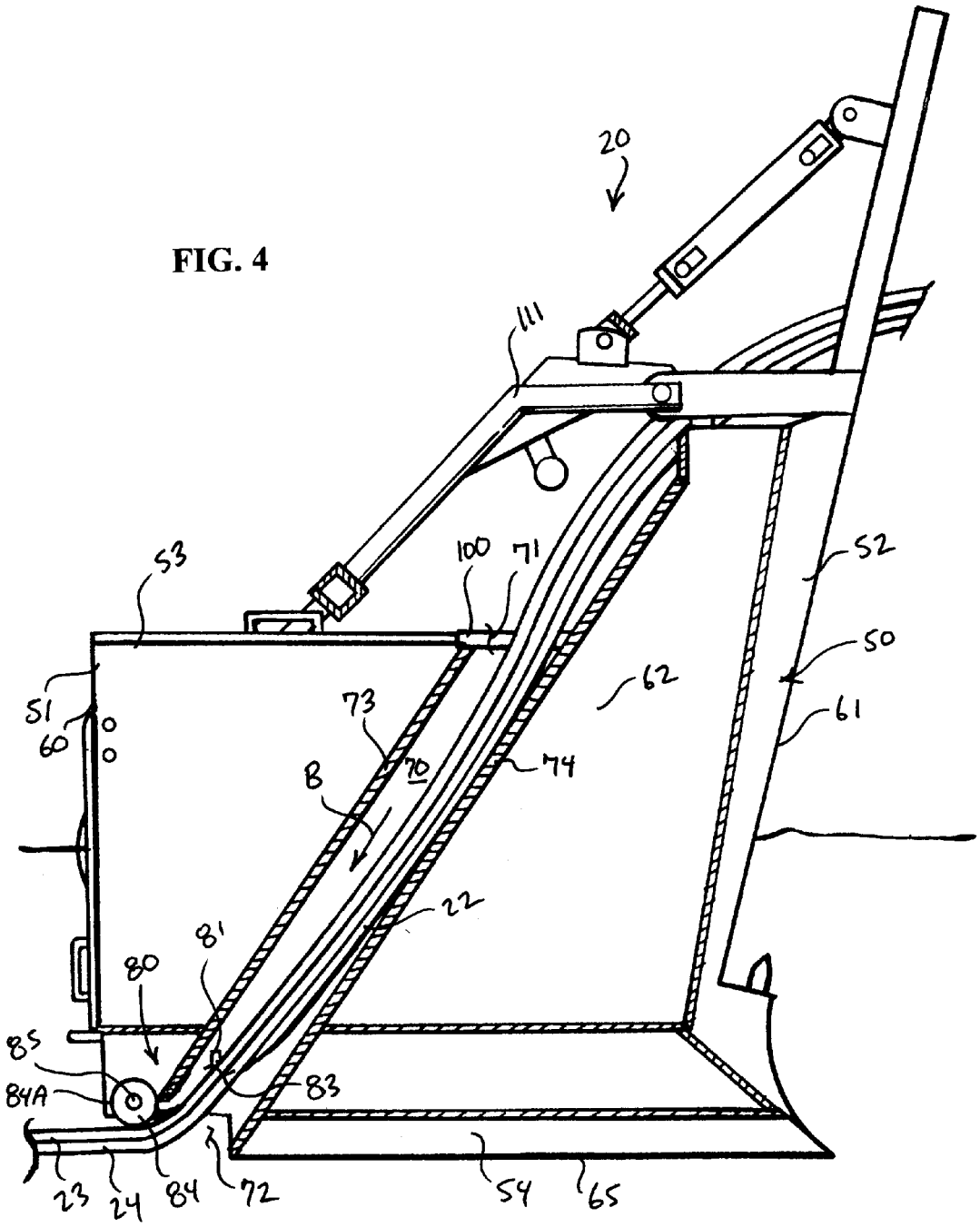
FIG. 4 is a sectional view taken along line 4-4 of FIG. 2.

Referencing in relevant part FIGS. 2-4, trencher boot 20 is a robust, rugged and substantial implement formed of steel or other strong, resilient material or combination of materials, and consists of an ample boxlike structure 50 having opposed leading and trailing ends 51 and 52, opposed upper and lower ends 53 and 54, and opposed sides 55 and 56. Boxlike structure 50 is formed with a front end wall 60 form at leading end 51, a rear end wall 61 formed at trailing end 52, opposed, substantially parallel side walls 62 and 63 formed at opposed sides 55 and 56, respectively, and a V-shaped blade structure 65 formed at lower end 54 of boxlike structure 50, which extends along substantially the entire length of lower end 54 of boxlike structure 50 from leading end 51 to trailing end 52. Blade structure 65 formed in lower end 54 of boxlike structure 50 is to engage the bottom of a trench formed by a trencher to form a substantially V-shaped receiving area in the bottom of the trench as the trencher boot is advanced through the trench formed by the trencher, further details of which will be discussed later in this specification.

FIG. 4 is a sectional view of trencher boot 20 taken along line 4-4 of FIG. 2. As seen in FIG. 4, a compartment 70 is formed within boxlike structure 50 forming trencher boot 20. Compartment 70 extends downwardly along a downward path of travel indicated by the arrowed line B from an inlet 71 formed in upper end 53 of boxlike structure 50 of trencher boot 20 adjacent to leading end 51 to an outlet 72 formed in lower end 54 of boxlike structure 50 of trencher boot 20 adjacent to trailing end 52. Compartment 70 is bound by opposed, parallel frontward and rearward compartment walls 73 and 74 formed within boxlike structure 50, which are affixed to, and extend between, opposed side walls 62 and 63 (side wall 63 not illustrated in FIG. 4). Compartment walls 73 and 74 are rigidly affixed to the inner surfaces of side walls 62 and 63, such as by welding. In another embodiment, compartment walls 73 and 74 may be integrally formed with side walls 62 and 63.

A cable-orienting structure 80 is formed within compartment 70 as illustrated in FIG. 4 between inlet 71 to compartment 70 and outlet 72 from compartment 70. Cable-orienting structure 80 associated with compartment 70 is located at lower end 54 of boxlike structure 50 adjacent to outlet 72 from compartment 70. Compartment 70 is to concurrently receive cables 22, 23, and 24, at inlet 71, guide cables 22, 23, and 24 downwardly toward lower end 54 of boxlike structure 50 from inlet 71 to cable-orienting structure 80, which interacts with cables 22, 23, and 24, to arrange cables 22, 23, and 24, in a V-shaped orientation as illustrated in FIGS. 5-9 consisting of two cables 22 and 23 positioned side-by-side atop the third cable 24, and guide cables 22, 23, and 24, in this inverted V-shaped orientation from cable-orienting structure 80 to lower end 54 of trencher boot 20 and outwardly through outlet 72 to be applied to the bottom of a trench as will be described in greater detail below.

Figure 5:
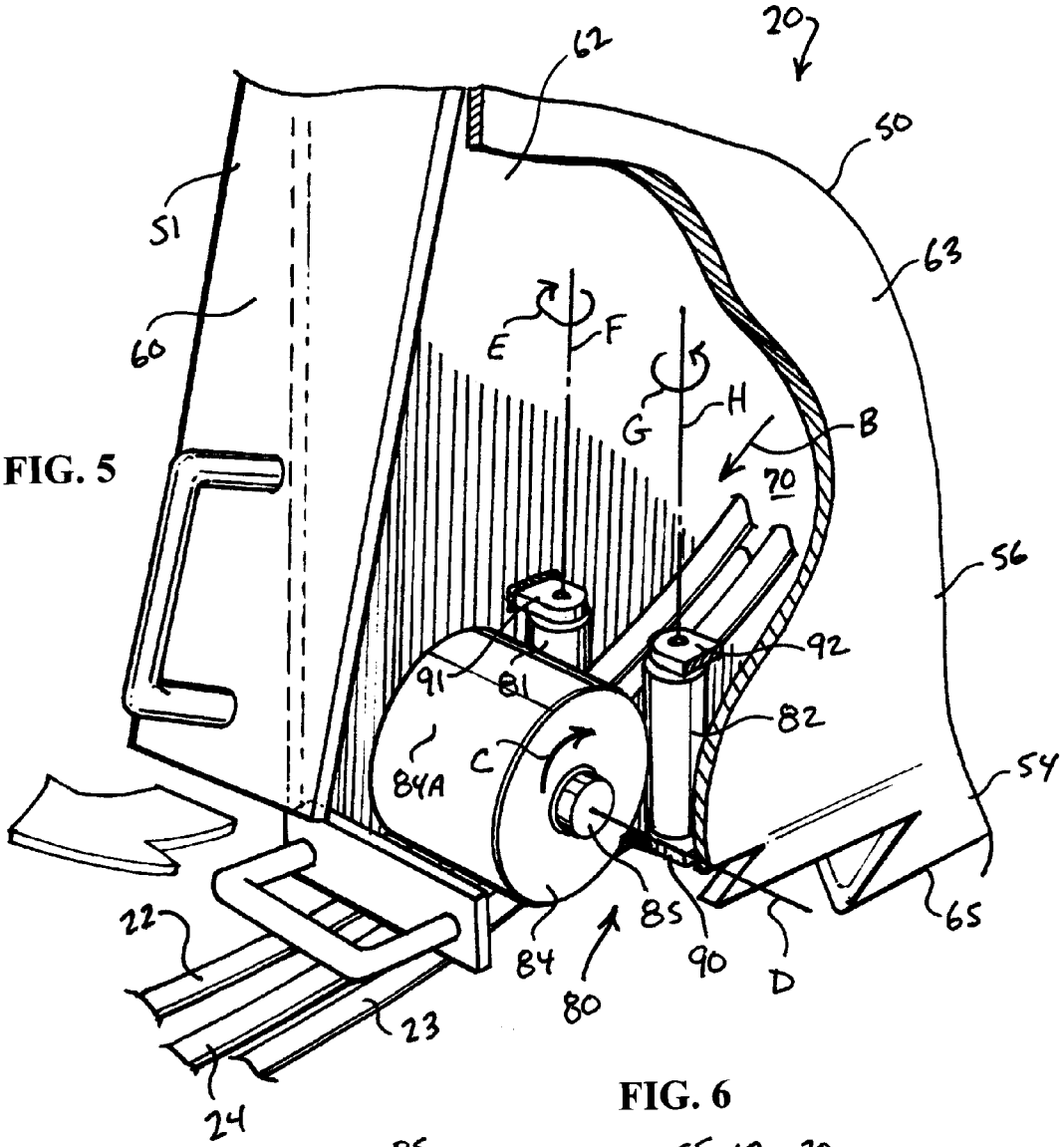
FIG. 5 is an enlarged, fragmented perspective view of the trencher boot of FIG. 1, with portions thereof broken away illustrating a cable-orienting structure formed within the trencher boot.
Figure 6:
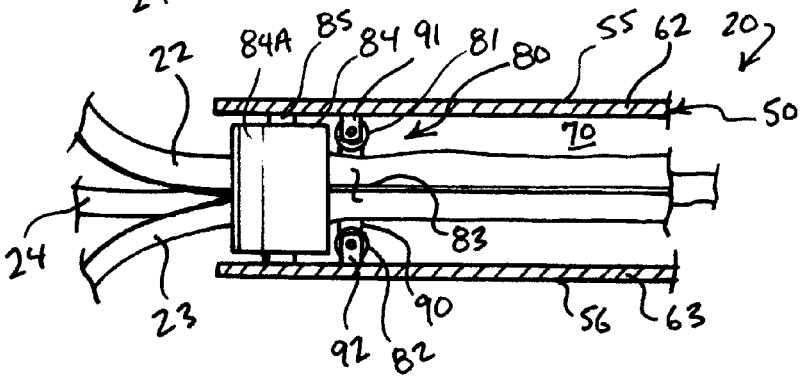
FIG. 6 is a sectional view taken along line 6-6 of FIG. 2.

Referring to FIGS. 5 and 6, cable-orienting structure 80 includes bump outs 81 and 82 formed on either side of compartment 70 adjacent to outlet 72 between inlet 71 and outlet 72 to define a restricted region 83 of compartment 70 therebetween. Referencing FIG. 6, bump out 81 in compartment 70 is formed along the inner surface of side wall 62 at side 55 of boxlike structure 50 of trencher boot 20, and bump out 82 in compartment 70 is formed along the inner surface of side wall 63 at side 56 of boxlike structure 50 of trencher boot 20 opposing bump out 81. Bump outs 81 and 82 extend into compartment 70 from sides 55 and 56, respectively, of boxlike structure 50 forming restricted region 83 therebetween. Referencing FIGS. 5 and 6, as cables 22, 23, and 24, pass through compartment 70 from inlet 71 to outlet 72 along path of travel B, cables 22, 23, and 24 pass into and through restricted region 83, and bump outs 81 and 82 interact with cables 22, 23, and 24 passing through restricted region 83 to arrange cables 22, 23, and 24, in the V-shaped orientation illustrated in FIGS. 5-9. A guide roller 84 is also part of cable-orienting structure 80, and is formed between outlet 72 leading from compartment 70, and bump outs 81 and 82. Guide roller 84 receives cables 22, 23, and 24 in the V-shaped orientation from bump outs 81 and 82 applies cables 22, 23, and 24 in the V-shaped orientation outwardly from trencher boot 20 through outlet 72 and into the bottom of a trench.

Guide roller 84 extends across compartment 70 adjacent to outlet 72 from proximate to the inner surface of side wall 62 to proximate to the inner surface of side wall 63. Guide roller 84 is cylindrical and has a cylindrical outer surface 84A, and has a diameter on the order of approximately 6-12 inches, in which the diameter of guide roller 84 extends along a straight line passing through the center of guide roller 84 meeting cylindrical outer surface 84A at each end. Guide roller 84 is supported by side walls 62 and 63, and is mounted for rotation. In this specific embodiment, guide roller 84 is mounted for rotation to an axle 85, which extends across compartment 70 from the inner surface of side wall 62 to the inner surface of side wall 63, and which is rigidly affixed to side walls 62 and 63, such as by press-fitting into corresponding receiving areas or openings form in side walls 62 and 63, welding, etc. Guide roller 84 rotates in a direction indicated by the arcuate arrowed line C along an axis of rotation D of roller 84 defined by the geometric, longitudinal center of axle 85, which extends across compartment 70 and which is perpendicular relative to path of travel B of cables 22, 23, and 24 through compartment 70 from inlet 71 to outlet 72 illustrated in FIG. 4. Cylindrical outer surface 84A of roller 84 is perpendicular relative to the path of travel B of cables 22, 23, and 24 through compartment 70.

Bump out 81 is attached to side wall 62, and bump out 82 is attached to side wall 63. Bump out 81 resides in juxtaposition relative to the inner surface of side wall 62, and bump out 82 resides in juxtaposition relative to the inner surface of side wall 63. Bump outs 81 and 82 oppose one another, extend upright and are substantially parallel relative to one another, and are each substantially equal in size and substantially perpendicular relative to cylindrical outer surface 84A of roller 84, and axis of rotation D of roller 84. In this embodiment, a truss 90 extends across compartment 70 from the inner surface of side wall 62 to the inner surface of side wall 63, and is rigidly affixed to the inner surfaces of side walls 62 and 63, such as by welding. A bracket 91 is rigidly affixed, such as by welding, to side wall 62 and extends inwardly into compartment 70, and a bracket 92 is rigidly affixed, such as by welding, to side wall 63 and extends inwardly into compartment 70. Bracket 91 is located above and opposes truss 90, and bracket 92 is located above and opposes truss 90. Bump out 81 is captured by and held between bracket 91 and truss 90 at side wall 62 of boxlike structure 50 of trencher boot 20, and bump out 82 is captured by and held between bracket 92 and truss 90 at side wall 63 of boxlike structure 50 of trencher boot 20.

Bump outs 81 and 82 are buffered to prevent damaging cables 22, 23, and 24 as they pass through restricted region 83 and interact with bump outs 81 and 82. In this preferred embodiment, bump outs 81 and 82 are elongate, cylindrical rollers, which provide the buffering by rotating in response to interacting with either of three cables 22, 23, and 24 as they pass through restricted region 83 in compartment 70. Bump out 81 is mounted for rotation to bracket 91 and truss 90, and bump out 82 is mounted for rotation to bracket 92 and truss 90. In the present embodiment, bump out 81 is conventionally journaled to bracket 91 and truss 90, and bump out 82 is conventionally journaled to bracket 92 and truss 90. Bump out 81 rotates in a direction indicated by the arcuate arrowed line E along an axis of rotation F of bump out 81 defined by the geometric, longitudinal center of bump out 81, which extends upright and which is perpendicular relative to path of travel B of cables 22, 23, and 24 through compartment 70 from inlet 71 to outlet 72 illustrated in FIG. 4, and which is also substantially perpendicular relative to cylindrical outer surface 84A and axis of rotation D of guide roller 84. Bump out 82 rotates in a direction indicated by the arcuate arrowed line G along an axis of rotation H of bump out 82 defined by the geometric, longitudinal center of bump out 82, which extends upright and which is perpendicular relative to path of travel B of cables 22, 23, and 24 through compartment 70 from inlet 71 to outlet 72 illustrated in FIG. 4, and which is also substantially perpendicular relative to cylindrical outer surface 84A and axis of rotation D of guide roller 84. The direction of rotation of bump out 81 indicated by the arcuate arrowed line E is opposite to the direction of rotation of bump out 82 indicated by the arcuate arrowed line G. Axis of rotation F of bump out 81 opposes and is parallel to axis of rotation H of bump out 82.

Cables 22, 23, and 24 pass into compartment 70 through inlet 71. In accordance with the principle of the invention, inlet 71 into compartment 70 is buffered to prevent damage to cables 22, 23, and 24 entering compartment through inlet 71. In a particular embodiment, inlet 71 into compartment 70 is buffered by rollers 100 illustrated in FIG. 2 formed on either side of inlet 71 at sides 55 and 56 of boxlike structure 50 at upper end 53 of boxlike structure 50. Cables 22, 23, and 24 may be directed into inlet 71 from side 55 and/or side 56 of boxlike structure 50, and each one of rollers 100 roll in response to one or more of cables 22, 23, and 24 running there-across through inlet 71 in advancing into compartment 70 through inlet 71, which thus provides the described buffering to prevent cable damage. If desired, rollers 100 may be replaced simply with rounded features or edges to provide an acceptable buffering to prevent cable damage.

Looking to FIG. 2, a pair of opposed plows 110 are formed with trencher boot 20. One plow 110 is located and maintained alongside side 55 of trencher boot 20 at leading end 51, and the other plow 110 is located and maintained alongside side 56 of trencher boot 20 at leading end 51. Each plow 110 is an agricultural implement used to lift and turn fill being exemplary of a plane, which characterizes a typical plow or plow-like implement. Plows 110 are substantially equal in size and shape, and are supported by a framework 111 affixed to trencher boot 20. Framework 111 supports and maintains plows 110 at sides 55 and 56, respectively, of trencher boot 20 at leading end 51 of trencher boot 20.

As explained above in conjunction with FIG. 1, in use trencher boot 20 is towed behind trencher 21 and receives and lays three cables 22, 23, and 24, into bottom 28 of trench 25 formed by trencher 21. Towing trencher boot 20 behind trencher 21 involves, in this preferred embodiment, attaching trencher boot 20 directly to trench cutter 40. As such, trencher boot 20 raises and lowers concurrently with the raising and lowering of trench cutter 40. Referencing FIGS. 1-3, trencher boot 20 is secured to trench cutter 40 by affixing trailing end 52 of boxlike structure 50 to a strong, rugged, steel frame or support 120 of trench cutter 40 thereby maintaining trencher boot 20 directly behind trench cutter 40. Trailing end 52 of boxlike structure 50 of trencher boot 20 is rigidly affixed to support 120 with the use of welding, rivets, pivotal couplings, nut-and-bolt assemblies, or the like.

Figure 7:
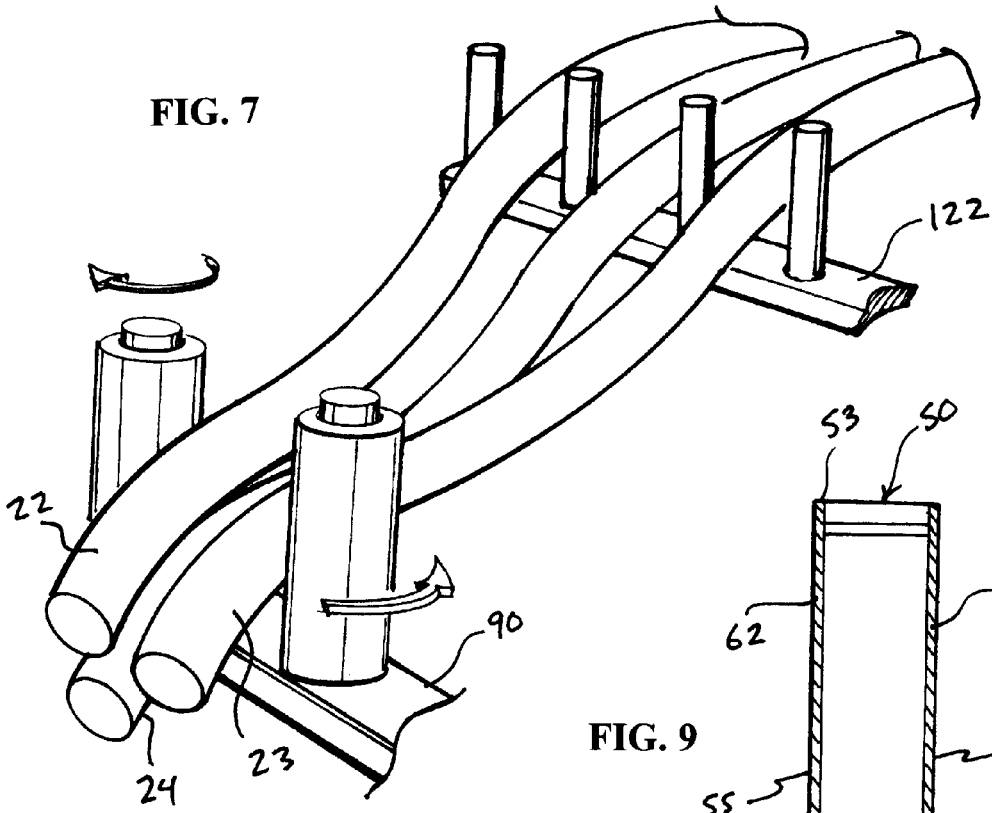
FIG. 7 is a fragmented perspective view of three cables shown as they would appear guided to a cable-orienting structure of the trencher boot of FIG. 1 from cable guides of the trencher of FIG. 1.

And so trencher boot 20 is specifically designed to lay three cables into a trench formed by trencher 21. In a cable-laying operation, trencher boot 21 is towed behind trencher 21 positioned on ground surface 26, and trench cutter 40 is activated and moved into its lowered position to cut into the ground through ground surface 26 to form trench 25, in which trencher boot 20 towed behind trench cutter 40 is also lowered into trench 25 as shown in FIG. 1 behind trench cutter 40. Cables 22, 23, and 24 are laid down alongside trencher 21 and are set into a cable guides 121 and 122 attached trencher 21. In this embodiment, cable guide 121 is attached to vehicle 30, and cable guide 122 is attached to trench cutter 40. Cable guides 121 and 122 take up and set cables 22, 23, and 24 alongside one another in preparation for application of cables 22, 23, and 24 into compartment 70 of trench boot 20 through inlet 71. Cables 22, 23, and 24 are then, in turn, directed into compartment 70 of trencher boot 20 through inlet 71 along one side thereof as illustrated in FIG. 4, and are passed downwardly through compartment 70 along path of travel B to cable-orienting structure 80. FIG. 7 is a schematic representation of cables 22, 23, and 24 taken up by cable guide 122 and passing from there to cable-orienting structure 80 passing through restricted region 83 between bump outs 81 and 82 above truss 90. At cable-orienting structure 80, cables 22, 23, and 24 are directed through restricted region 83 and oriented in restricted region in the V-shaped orientation as illustrated in FIGS. 5-9 consisting of two cables 22 and 23 positioned side-by-side atop the third cable 24. In this inverted V-shaped orientation, cables 22, 23, and 24 are then passed outwardly to bottom 28 of trench 25 through outlet 72 from compartment 70.

Before advancing trencher boot 20 in the application of cables 22, 23, and 24 to a trench, it may be required to manually orient cables in the V-shaped orientation at restricted region 83 between bump outs 81 and 82. After manually orienting cables 22, 23, and 24 in the V-shaped orientation, cable-orienting structure 80 maintains the orientation of cables 22, 23, and 24 in the V-shaped orientation as they pass through restricted region 83.

Figure 9:
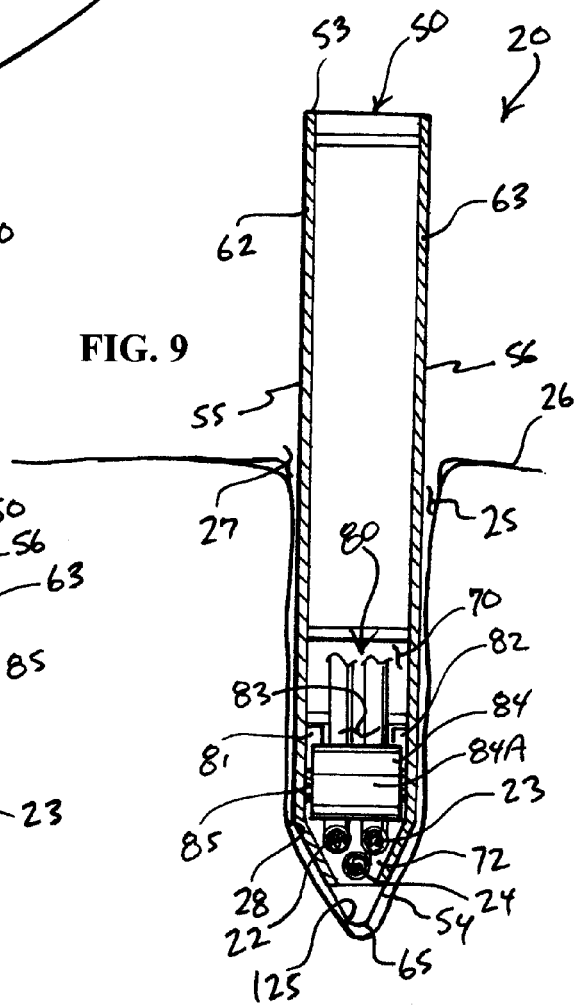
FIG. 9 is a sectional view taken along line 9-9 of FIG. 1.
Figure 8:
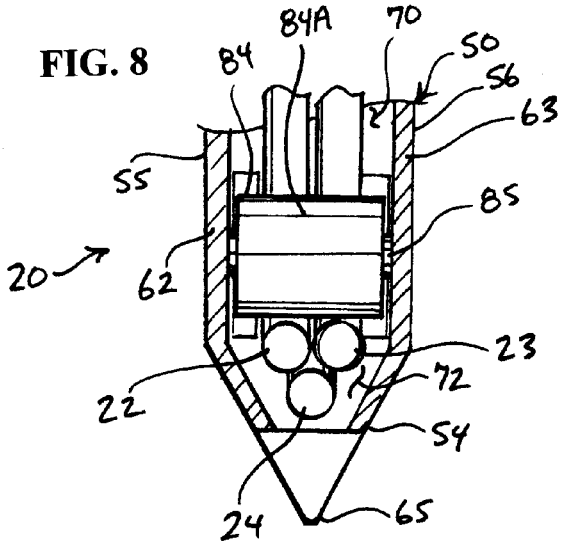
FIG. 8 is a sectional view taken along line 8-8 of FIG. 2.

In laying cables 22, 23, and 24, trencher boot 20 is positioned in trench 25 and blade structure 65 is applied against bottom 28 of trench 25 behind trench cutter 40. Trencher 21 is advanced along ground surface 26 in the direction indicated by the arrowed line A in FIG. 1 through the operation of vehicle 30. As trencher 21 advances in the direction indicated by the arrowed line A, trench cutter 40 cuts trench 25 and trencher boot 20 behind trench cutter 40 is concurrently advanced through trench 25 in a direction from leading end 51 of trencher boot 20 to trailing end 52 of trencher boot 20, in which trencher boot 20 maintains the shape of trench 25 preventing trench from collapsing in on itself and blade structure 65 is applied against bottom 28 of trench 25 and interacts against bottom 28 of trench 25 cutting or otherwise forming a V-shaped receiving area 125 into bottom 28 of trench as illustrated in FIG. 9 trailing or otherwise behind trailing end 52 of trencher boot 20. As trencher 21 advances in the direction indicated by the arrowed line A in FIG. 1 forming trench 25 and advancing trencher boot 20 through trench 25 forming V-shaped receiving area 125 in bottom 28 of trench 25 as shown in FIG. 9, cables 22, 23, and 24 are picked up by cable guides 121 and 122 as illustrated in FIG. 1 and advanced to trencher boot 20 and are applied into and through compartment 70 from inlet 71 to outlet 72 as shown in FIG. 4, in which cable-orienting structure 80 receives cables 22, 23, and 24 and interacts with cables 22, 23, and 24 advancing through compartment 70 from inlet 71 to outlet 72 arranging cables 22, 23, and 24 in the V-shaped orientation, and then applies cables 22, 23, and 24 outwardly through outlet 72 in the V-shaped orientation to V-shaped receiving area 125 formed in bottom of trench 25 by blade structure 65 as shown in FIG. 10.

According to the principle of the invention, V-shaped receiving area 125 has a size and shape and the V-shaped orientation of cables 22, 23, and 24 discharging from outlet 72 of trencher boot 20 has a size and shape corresponding to that of the size and shape of V-shaped receiving area 125. Because the size and shape of V-shaped receiving area 125 is commensurate to or otherwise corresponds to the size and shape of the V-shaped orientation of cables 22, 23, and 24 discharging from outlet 72 of trencher boot 20, V-shaped receiving area 125 functions importantly to receive cables 22, 23, and 24 arranged in the V-shaped orientation, and also keep and maintain cables 22, 23, and 24 in the V-shaped orientation as shown in FIG. 10. This application of cables 22, 23, and 24 in the V-shaped orientation into V-shaped receiving area 125 that keeps and maintains cables 22, 23, and 24 in the V-shaped orientating is underground cable triplexing or otherwise the laying of three cables underground in a triplexed orientation, in accordance with the principle of the invention.

Guide roller 84 receives cables 22, 23, and 24 in the V-shaped orientation from restricted region 83 formed by bump outs 81 and 82 and applies cables 22, 23, and 24 in the V-shaped orientation outwardly from trencher boot 20 through the outlet 72 to V-shaped region 125 formed in bottom 28 of trench 25. In receiving cables 22, 23, and 24, cables 22, 23, and 24 run underneath guide roller 84, whereby cables 22 and 23 positioned side-by-side are received against cylindrical outer surface 84A of roller 84 imparting rotation to guide roller 84 in the direction indicated by the arcuate arrowed line C in FIG. 5 as cables 22, 23, and 24 advance through compartment 70 of trencher boot 20 along path of travel B, which applies cables 22, 23, and 24 through outlet 72 arranged in the V-shaped orientation into V-shaped receiving area 125 formed in bottom 28 of trench 25. As discussed previously, the buffering formed in trencher boot 20 at inlet 71 prevent damage to cables 22, 23, and 24 as they enter compartment 70 through inlet.

Figure 10:
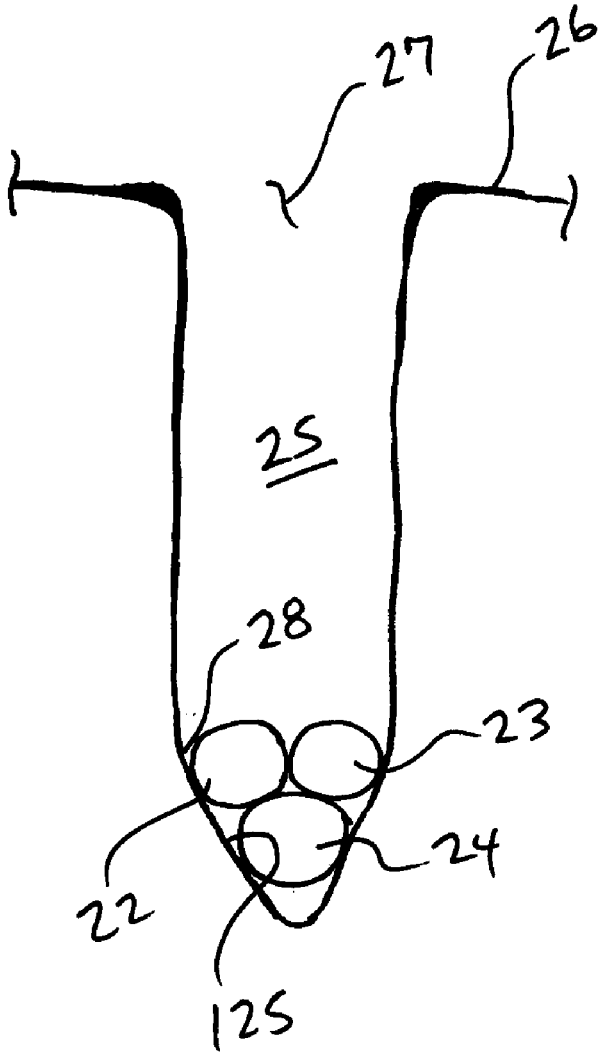
FIG. 10 is a sectional view taken along line 10-10 of FIG. 1.

After cables 22, 23, and 24 are laid into V-shaped receiving area 125 formed in bottom of trench 25 as illustrated in FIG. 10, fill is applied into trench 25 to cover or otherwise bury cables 22, 23, and 24. Plows 110 perform this function by interacting with fill on either side of trench 25 as illustrated in FIGS. 11 and 12 (only one plow 110 is shown in FIG. 11) at trailing end 52 of trencher boot 20 and directing the fill into trench 24.

The application of fill into trench 25 applies a considerable amount of pressure on cables 22, 23, and 24. Also, cables 22, 23, and 24 generate a considerable amount of heat in passing electricity. The V-shaped orientation of cables 22, 23, and 24 received in and maintained by V-shaped receiving area 125 allows cables 22, 23, and 24 to better withstand the pressure forces applied to cables 22, 23, and 24 by the fill applied to trench 25 as compared to conventional cable arrangements, and also allows the fill material surrounding and burying cables 22, 23, and 24 to dissipate heat generated by cables 22, 23, and 24 better and more efficiently as compared to conventional cable arrangements, all of which contribute to prolonged cable life coupled with improved cable performance, in accordance with the principle of the invention.

The present invention is described above with reference to a preferred embodiment. However, those skilled in the art will recognize that changes and modifications may be made in the described embodiment without departing from the nature and scope of the present invention. Various changes and modifications to the embodiment herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

1. Apparatus for laying three cables onto a bottom of a trench, comprising:

a trencher boot having opposed leading and trailing ends, opposed upper and lower ends, opposed sides forming a boxlike structure, and a blade structure formed in the lower end of the boxlike structure to engage the bottom of the trench to form a substantially V-shaped receiving area in the bottom of the trench as the trencher boot is advanced through the trench;

a compartment formed within the trencher boot extending from an inlet formed in the upper end of the trencher boot adjacent to the leading end of the trencher boot to an outlet formed in the lower end of the trencher boot adjacent to the trailing end of the trencher boot;

a cable-orienting structure formed within the compartment between the inlet and the outlet;

the compartment to concurrently receive three cables from the inlet, guide the three cable to the cable-orienting structure, which interacts with the three cables to arrange the three cables in a V-shaped orientation comprising two of the three cables positioned side-by-side atop a third one of the three cables, and guide the three cables in the V-shaped orientation from the cable-orienting structure to the lower end of the trencher boot and outwardly through the outlet into the V-shaped receiving area formed in the bottom of the trench; and the V-shaped receiving area sized and shaped to receive the three cables in the V-shaped orientation from the outlet of the trencher boot and maintain the three cables in the V-shaped orientation.

2. Apparatus for laying three cables onto a bottom of a trench according to claim 1, wherein the cable-orienting structure comprises a bump out formed on either side of the compartment adjacent to the outlet to define a restricted region of the compartment therebetween, the bump outs interacting with the three cables passing through the restricted region to arrange the three cables in the V-shaped orientation.

3. Apparatus for laying three cables onto a bottom of a trench according to claim 2, further comprising a guide roller formed between the outlet of the compartment and the bump outs, the guide roller to receive the cables in the V-shaped orientation from the bump outs and apply the cables in the V-shaped orientation outwardly from the trencher boot through the outlet.

4. Apparatus for laying three cables onto a bottom of a trench according to claim 1, wherein the inlet into the compartment is buffered to prevent damage to the three cables entering the compartment through the inlet.

5. Apparatus for laying three cables onto a bottom of a trench according to claim 4, wherein the inlet into the compartment is buffered with at least one roller formed in the upper end of the trencher boot at the inlet.

6. Apparatus for laying three cables onto a bottom of a trench according to claim 1, further comprising at least one plow formed with the trencher boot to direct fill into the trench onto the three cables applied to the V-shaped receiving area as the trencher boot is advanced through the trench in a direction leading with the leading end of the trencher boot.

7. Apparatus for laying three cables onto a bottom of a trench, comprising:

a trencher boot having opposed leading and trailing ends, opposed upper and lower ends, opposed sides forming a boxlike structure, and a blade structure formed in the lower end of the boxlike structure to engage the bottom of the trench to form a substantially V-shaped receiving area in the bottom of the trench as the trencher boot is advanced through the trench;

a compartment formed within the trencher boot extending from an inlet formed in the upper end of the trencher boot adjacent to the leading end of the trencher boot to an outlet formed in the lower end of the trencher boot adjacent to the trailing end of the trencher boot;

orienting rollers formed on either side of the compartment between the inlet and the outlet defining a restricted region of the compartment therebetween;

the compartment to concurrently receive three cables from the inlet, guide the three cables to the restricted region formed between the orienting rollers, which interact with the three cables to arrange the three cables in a V-shaped orientation comprising two of the three cables positioned side-by-side atop a third one of the three cables, and guide the three cables in the V-shaped orientation from the orienting rollers to the lower end of the trencher boot and outwardly through the outlet into the V-shaped receiving area formed in the bottom of the trench; and the V-shaped receiving area sized and shaped to receive the three cables in the V-shaped orientation from the outlet of the trencher boot and maintain the three cables in the V-shaped orientation.

8. Apparatus for laying three cables onto a bottom of a trench according to claim 7, further comprising a guide roller formed between the outlet of the compartment and the orienting rollers, the guide roller to receive the cables in the V-shaped orientation from the orienting rollers and apply the cables in the V-shaped orientation outwardly from the trencher boot through the outlet.

9. Apparatus for laying three cables onto a bottom of a trench according to claim 7, wherein the inlet into the compartment is buffered to prevent damage to the three cables entering the compartment through the inlet.

10. Apparatus for laying three cables onto a bottom of a trench according to claim 9, wherein the inlet into the compartment is buffered with at least one roller formed in the upper end of the trencher boot at the inlet.

11. Apparatus for laying three cables onto a bottom of a trench according to claim 7, further comprising at least one plow formed with the trencher boot to direct fill into the trench onto the three cables applied to the V-shaped receiving area as the trencher boot is advanced through the trench in a direction leading with the leading end of the trencher boot.

12. A method for laying three cables onto a bottom of a trench, comprising:

providing a trencher boot having opposed leading and trailing ends, opposed upper and lower ends, opposed sides forming a boxlike structure, a blade structure formed in the lower end of the boxlike structure, a compartment formed within the trencher boot extending from an inlet formed in the upper end of the trencher boot adjacent to the leading end of the trencher boot to an outlet formed in the lower end of the trencher boot adjacent to the trailing end of the trencher boot, and a cable-orienting structure formed within the compartment between the inlet and the outlet;

positioning the trencher boot in the trench applying the blade structure against the bottom of the trench;

advancing the trencher boot through the trench in a direction from the leading end of the trencher boot the trailing end of the trencher boot, the blade structure interacting with the bottom of the trench forming a V-shaped receiving area trailing the trailing end of the trencher boot;

applying three cables into and through the compartment from the inlet to the outlet, the cable-orienting structure interacting with the three cables between the inlet and the outlet arranging the three cables in a V-shaped orientation comprising two of the three cables positioned side-by-side atop a third one of the three cables, and applying the three cables in the V-shaped orientation to the V-shaped receiving area from the outlet of the compartment; and the V-shaped receiving area receiving the three cables in the V-shaped orientation from the outlet of the trencher boot, and maintaining the three cables in the V-shaped orientation.

13. A method for laying three cables onto a bottom of a trench according to claim 12, the cable-orienting structure comprising a bump out formed on either side of the compartment adjacent to the outlet to define a restricted region of the compartment therebetween, the three cables passing through the restricted region and the bump outs interacting with the three cables passing through the restricted region to arrange the three cables in the V-shaped orientation.

14. A method for laying three cables onto a bottom of a trench according to claim 12, further comprising applying a guide roller within the trencher boot adjacent to the outlet, the guide roller receiving the cables in the V-shaped orientation from the bump outs and applying the cables in the V-shaped orientation outwardly from the trencher boot through the outlet to the V-shaped region formed in the bottom of the trench.

15. A method for laying three cables onto a bottom of a trench 12, further comprising buffering the inlet into the compartment to prevent damage to the three cables entering the compartment through the inlet.

16. A method for laying three cables onto a bottom of a trench according to claim 15, wherein the step of buffering the inlet into the compartment further comprises applying at least one roller in the upper end of the trencher boot at the inlet.

17. A method for laying three cables onto a bottom of a trench 12, further comprising applying fill to the trench to cover the cables applied to the V-shaped region formed in the bottom of the trench.

18. A method for laying three cables onto a bottom of a trench according to claim 17, wherein the step of applying fill to the trench further comprises:

forming at least one plow with the trencher boot; and the at least one plow directing fill into the trench onto the three cables applied to the V-shaped receiving area as the trencher boot is advanced through the trench.

* * * * *